US005226381A

United States Patent [19]

Moody

[11] Patent Number: 5,226,381

[45] Date of Patent: Jul. 13, 1993

[54] TORPEDO TUBE HULL LINER CLUSTER AND METHOD FOR MAKING SAME

[75] Inventor: Paul E. Moody, Barrington, R.I.

[73] Assignee: The United States of America as represented by the Secretary of the Navy, Washington, D.C.

[21] Appl. No.: 940,151

[22] Filed: Sep. 3, 1992

[51] Int. Cl.[5] ..... B63B 3/13

[52] U.S. Cl. ..... 114/316

[58] Field of Search ..... 114/316-320, 114/238, 312; 89/1.810

[56] References Cited

U.S. PATENT DOCUMENTS 5,044,253 9/1991 Moody ..... 114/318 X

*Primary Examiner*—Sherman Basinger

*Attorney, Agent, or Firm*—Michael J. McGowan; Prithvi C. Lall; James M. Kasischke

[57] ABSTRACT

A densely packaged torpedo tube hull liner cluster for use in a pressure hull of a submarine, the cluster comprising a rigid I-beam having first and second flanges interconnected by a web portion, and having an end block fixed to either end of the beam. The flanges and the end blocks are provided with oppositely disposed seats of respective first and second radii therein. A first torpedo tube liner having a radius substantially equal to the first radius is fixed to the beam flanges and end blocks in a first of the seats, and a second torpedo tube liner having a radius substantially equal to the second radius is fixed to the beam flanges and end blocks in a second of the seats. The beam is disposed between the first and second liners and is adapted for attachment to a submarine pressure hull in an opening therein adapted to receive the beam and liners. Further contemplated, is a method for making the cluster of beam and liners and fixing the cluster to the submarine pressure hull.

13 Claims, 4 Drawing Sheets

TORPEDO TUBE HULL LINER CLUSTER AND METHOD FOR MAKING SAME

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The invention relates to torpedo tube hull liners and is directed more particularly to a cluster of hull liners arranged such that the liners are closer together than has heretofore been possible, permitting a smaller torpedo room without loss of fire power or more torpedo tubes in a current size torpedo room. The invention further includes a method for assembling the cluster and fitting the cluster to a submarine pressure hull.

(2) Description of the Prior Art

A torpedo tube hull liner is a rigid, thick-walled cylindrical pipe which passes through a submarine's hull. A torpedo tube is installed inside each liner. The liner will distort when subjected to sea pressure in a nonuniform manner, due to the complex hull curvatures connecting the liner to the hull. However, this nonuniform distortion of the liner is not transmitted to the torpedo tube as the liner/torpedo tube intersection is uniformly located around the torpedo tube's centerline. In accordance with current practice, holes are cut in the submarine pressure hull and into each hole there is placed and welded a circular hull liner. The liners cannot be placed closely adjacent each other inasmuch as there must be room completely around the liner for an operator to weld the liner to the hull.

To produce a smaller and less expensive submarine, it has become essential to downsize the boat overall, including the torpedo room. Under current practices, downsizing the torpedo room results in loss of firepower, inasmuch as fewer torpedo tube liners, and therefore fewer torpedo tubes can be fitted into a given area.

It would be beneficial to have available a cluster of two or more liners in which the liners are closely adjacent one another and the cluster is adapted to be properly welded to the pressure hull.

SUMMARY OF THE INVENTION

An object of the invention is, therefore, to provide a torpedo tube hull liner cluster of closely adjacent liners for use in a pressure hull of a submarine or other torpedo-firing platform.

A further object of the invention is to provide a method for assembling a cluster of closely adjacent torpedo tube hull liners for insertion into an opening in a submarine's hull and attachment thereto.

With the above and other objects in view, as will hereinafter appear, a feature of the present invention is the provision of a torpedo tube hull liner cluster for use in a pressure hull of a submarine. The cluster comprises a rigid beam having side wall portions and end wall portions, the beam being provided with a first curved seat formed in the end wall and side wall portions thereof having a first radius and a second curved seat formed in the end wall and side wall portions thereof having a second radius. The cluster further includes a first torpedo tube hull liner having a radius substantially equal to the first radius and fixed to the rigid beam in the first seat, and a second torpedo tube hull liner having a radius substantially equal to the second radius and fixed to the rigid beam in the second seat. The rigid beam is disposed between the first and second torpedo tube hull liners and is adapted for attachment to the submarine pressure hull in an opening in the hull.

In accordance with a further feature of the invention, there is provided a method for assembling a cluster of torpedo tube hull liners for insertion into an opening in a submarine pressure hull and attachment thereto. The method comprises the steps of providing a rigid beam having side walls and end walls, forming a first seat of a first radius in the rigid beam and a second seat of a second radius in the rigid beam. The method further comprises fixing a first curved plate having an outside radius substantially equal to the first radius to the beam and in the first seat and a second curved plate having an outside radius substantially equal to the second radius to the beam and in the second seat. An opening is then provided in the submarine pressure hull adapted to receive the beam and the hull liners. The beam is attached to the pressure hull in the opening, followed by fixing additional curved plates of the first radius to the first curved plate to complete a first of the hull liners, and fixing additional curved plates of the second radius to the second curved plate to complete a second of the hull liners, and fixing the hull liners in the opening to the pressure hull.

The above and other features of the invention, including various details of construction and combinations of parts, will now be more particularly described with reference to the accompanying drawings and pointed out in the claims. It will be understood that the particular device and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

A more complete understanding of the invention and many of the attendant advantages thereto will be readily appreciated as the invention becomes better understood by reference to the following detailed description when considered in conjunction with the accompanying drawings wherein.

DESCRIPTION OF THE PREFERRED EMBODIMENTS

Figure 1:
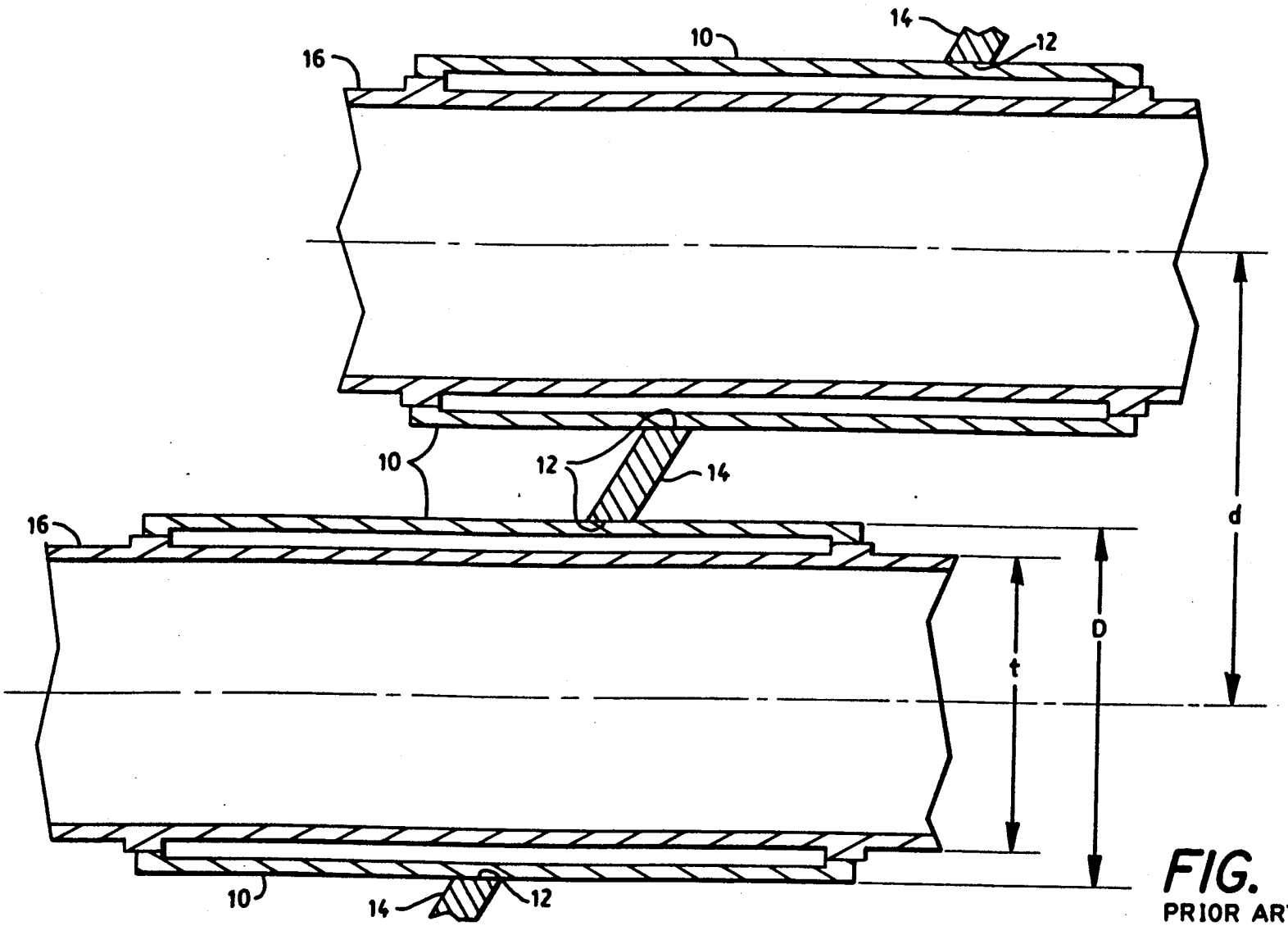
FIG. 1 PRIOR ART
FIG. 1 is a sectional view of a prior art arrangement of two torpedo tube hull liners fixed in a pressure hull, with torpedo tubes disposed within the liners.

Referring to FIG. 1, it will be seen that according to prior art practice torpedo tube hull liners 10 are fixed, as by welding, in holes 12 cut in a pressure hull 14 of a submarine, or other torpedo launching vehicle. Torpedo tubes 16 are then mounted in hull liners 10. Because sufficient space must be left between liners 10 to permit full penetration welding therearound, the centerline to centerline distance d between torpedo tubes of an outside diameter t of 24⅞ inches typically is about 43 inches.

Figure 2:
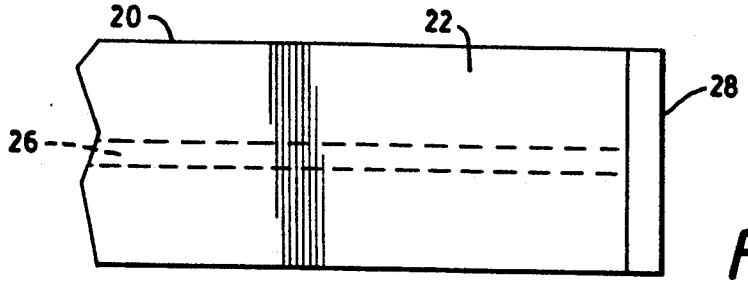
FIG. 2 is a side elevational view of an I-beam, with an end block fixed thereto, the I-beam being suitable for use in the illustrative embodiment of the invention.
Figure 3:
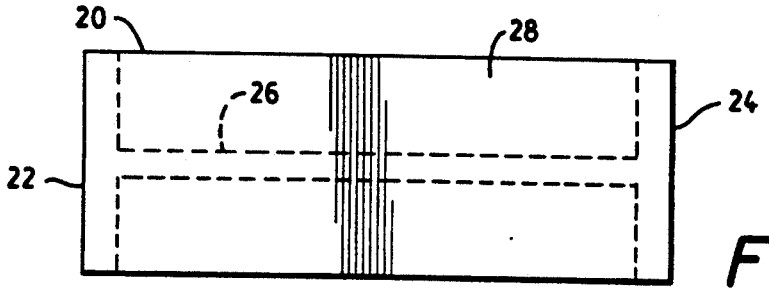
FIG. 3 is an end view of the I-beam of FIG. 2.

To decrease the spacing between hull liners 10, there is provided a rigid beam, preferably in the form of an I-beam 20 (FIGS. 2 and 3), having side walls, such as first and second flanges 22, 24, which, in the case of an I-beam, are interconnected by a web portion 26. The rigid beam is provided with end walls, which, in the case of I-beam 10, are end blocks 28 fixed to the ends of beam 10, as by welding.

Figure 4:
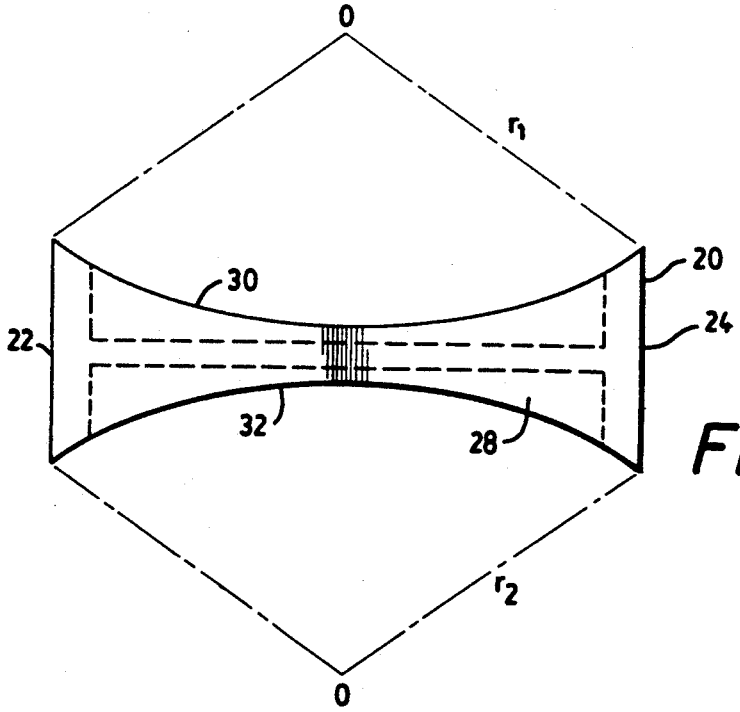
FIG. 4 is an end view of the I-beam, similar to FIG. 3, but showing first and second seats of selected radii formed in the I-beam.

Referring to FIG. 4, it will be seen that in furtherance of the method herein, a curved first seat 30 of a first radius $r_1$ is formed in upper edges of flanges 22, 24, as viewed in FIG. 4, and in upper edges of end blocks 28. Similarly, a curved second seat 32 of a second radius $r_2$ is formed in lower edges of flanges 22, 24, as viewed in FIG. 4, and in lower edges of end blocks 28.

Figure 5:
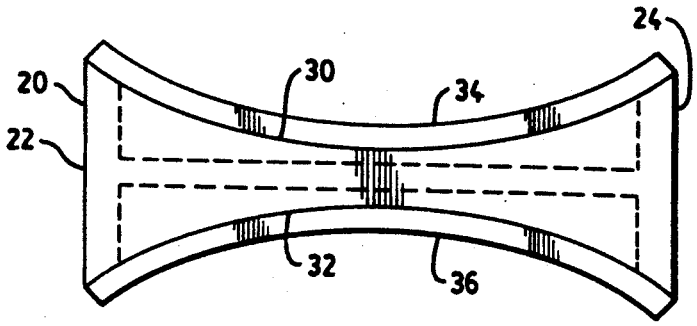
FIG. 5 is an end view, similar t o FIG. 4, but showing first and second curved plates disposed, respectively, in the first and second seats and fixed thereto.

Referring to FIG. 5, it will be seen that in furtherance of the method herein, a first curved plate 34 is attached, as by welding, to I-beam 20. The outside radius of plate 34 is substantially equal to first radius $r_1$ of first seat 30, such that plate 34 is complementary to first seat 30. In similar fashion, a second curved plate 36 is welded to I-beam 20. The outside radius of plate 36 is substantially equal to second radius $r_2$ of second seat 32, such that plate 36 is complementary to second seat 32. Normally, the first and second radii are equal, but such is not necessary. Thus, different radii may be used to accommodate different size torpedo tubes.

Figure 6:
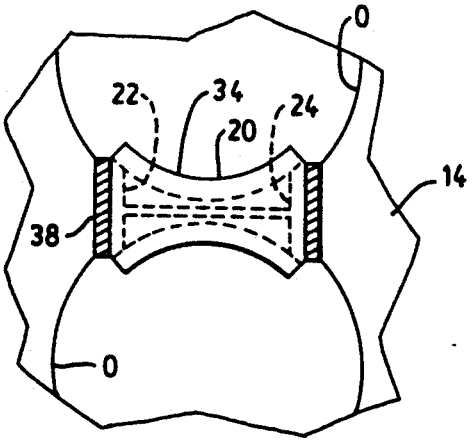
FIG. 6 is an end view of the I-beam and curved plates disposed in an opening in a pressure hull, with the I-beam fixed to the pressure hull.
Figure 7:
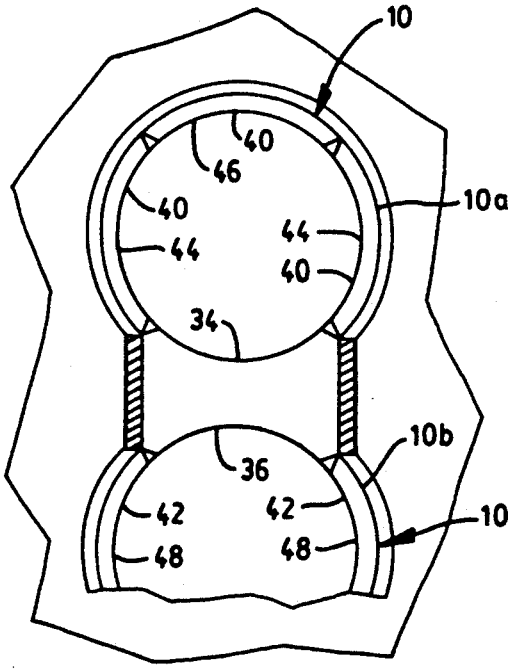
FIG. 7 is an end view of the I-beam of FIG. 6 with additional curved plates fixed to the first and second curved plates to complete the hull liners, and the cluster of two liners and I-beams disposed in the opening in the pressure hull.
Figure 8:
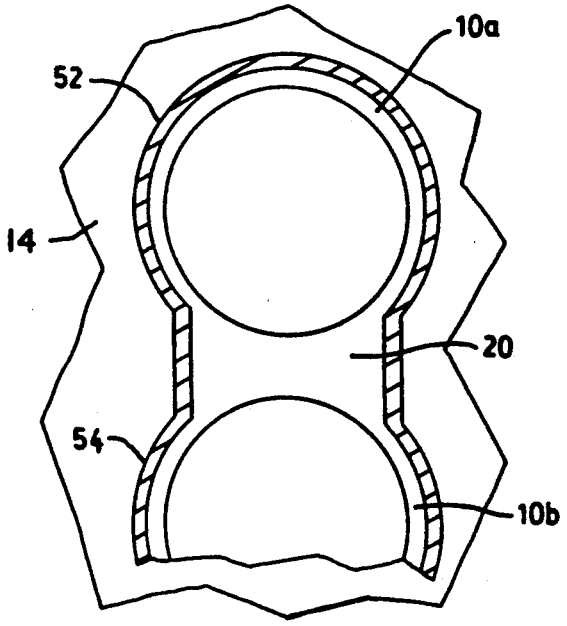
FIG. 8 is similar to FIG. 7, but shows the welding of the liners to the pressure hull.
Figure 11:
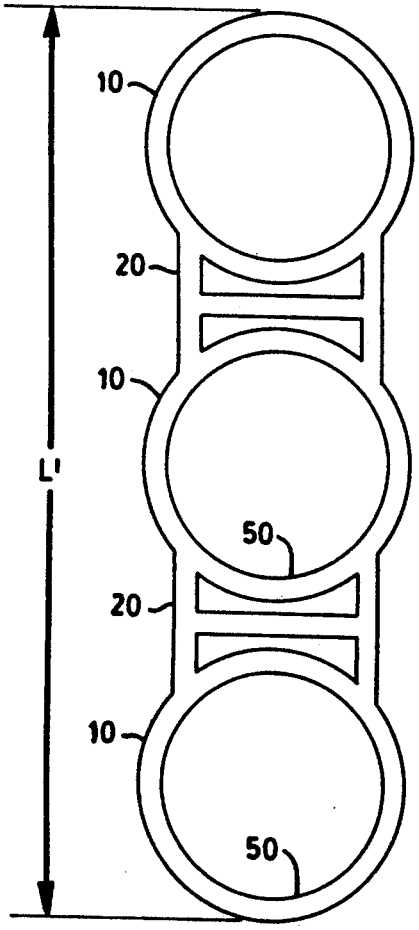
FIG. 11 is a diagrammatic end view illustrative of hull liner spacing in accordance with the present invention, drawn to the same scale as FIG. 10, for comparative purposes.

Referring to FIG. 6, an opening O is provided in a pressure hull portion H, the opening being sized and configured to receive I-beam 20 and two hull liners having radii $r_1$ and $r_2$ respectively. I-beam 20 is placed in the opening O in the hull 14 and fixed in place by welds 38. Inasmuch as the welding is undertaken on the sides of I-beam 20, along flanges 22, 24, lack of space between the liners does not raise a problem relative to the welding operation. As shown in FIG. 7, additional curved plates 40 of first radius $r_1$ are then attached, as by welding, to first curved plate 34, to complete a first 10*a* of the hull liners 10. Additional curved plates 42 of second radius $r_2$ are attached to second curved plate 36, to complete a second 10*b* of the hull liners 10. The additional curved plates 40 can include side plates 44 and a mid plate 46. Similarly, the additional curved plates 42 can include side plates 48 and a mid plate 50 (FIG. 11). The liners 10*a* and 10*b* are then welded peripherally to the hull 14, as by welds 52, 54 (FIG. 8).

Referring to FIG. 11, it will be seen that if a cluster of more than two hull liners is desired, one, or both, of the mid plates 46, 50 may constitute another curved plate portion fixed to an I-beam, such that three or more liners may be clustered, as illustrated in FIG. 11, wherein two I-beams 20 are shown in conjunction with three liners 10.

Figure 10:
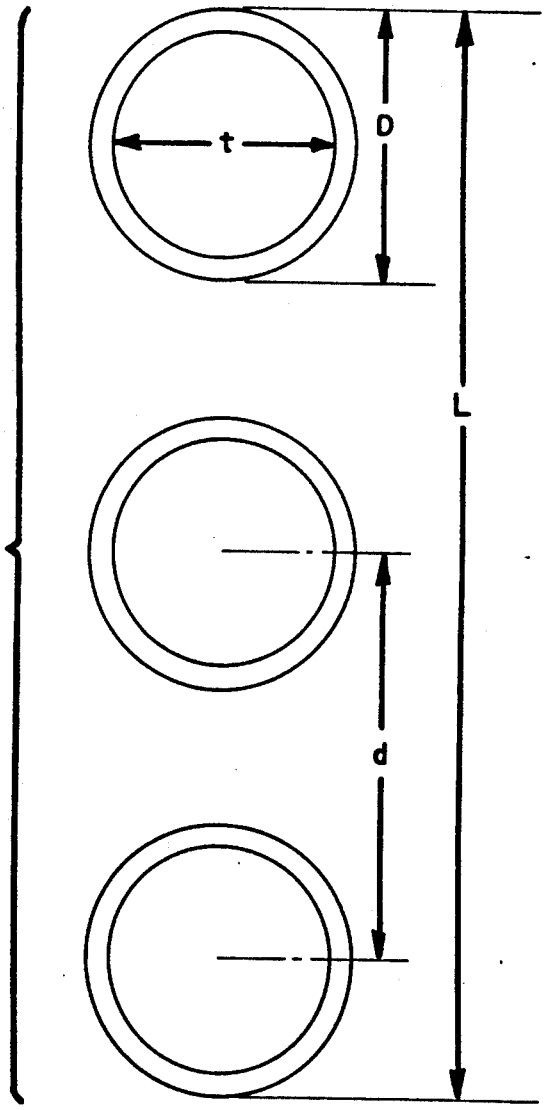
FIG. 10 PRIOR ART
FIG. 10 is a diagrammatic end view illustrative of prior art spacing of hull liners.

Referring to FIGS. 10 and 11, it will be seen that in accordance with prior art methods, three torpedo tube hull liners having outside diameters D of 28½ inches, for torpedo tubes having outside diameters t of 24⅞ inches, have a centerline-to-centerline spacing d of 43 inches and require, top to bottom L, 119½ inches (FIG. 10). In comparison, the cluster in accordance with the present invention provides three torpedo tube hull liners having outside diameters D of 28½ inches, for torpedo tubes having outside diameters of 24⅞ inches, having centerline-to-centerline distances of 32 inches, and require, top to bottom L', 92½ inches (FIG. 11), or about 23 percent less space heightwise, and about the same space widthwise. The centerline-to-centerline space d may be further reduced by providing for seats in the I-beam deeper into the I-beam, resulting in the curved plates 34, 36 being closer to, or abutting, the I-beam web portion 26.

Figure 9:
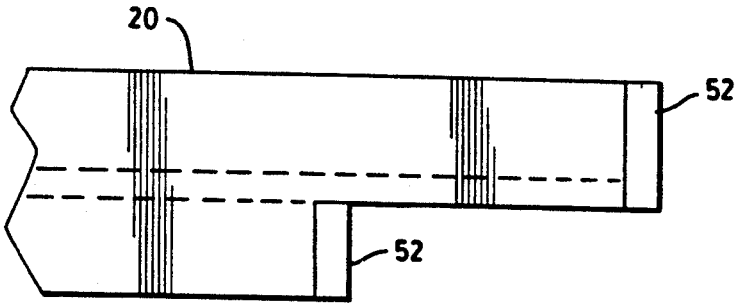
FIG. 9 is similar to FIG. 2, showing an alternative embodiment of I-beam.

Referring to FIG. 9, it will be seen that if the liners are to be offset from each other, rather than side by side coextensively, the I-beam 20 may be cut accordingly, and provided with end block segments 52, such that an end of one liner may be cradled somewhat forwardly of the end of a neighboring liner.

It is to be understood that the present invention is by no means limited to the particular construction and method herein disclosed and/or shown in the drawings, but also comprises any modifications or equivalents within the scope of the claims.

What is claimed is:

1. A torpedo tube hull liner cluster for use in a pressure hull of a submarine, said cluster comprising:

a rigid beam having side wall portions and end wall portions, the beam being provided with a first curved seat formed in a first portion thereof having a first radius and a second curved seat formed in a second portion thereof having a second radius;

a first torpedo tube hull liner having a radius substantially equal to said first radius fixed to said rigid beam in said first seat; and a second torpedo tube hull liner having a radius substantially equal to said second radius fixed to said rigid beam in said second seat;

said rigid beam being disposed between said first and second liners and being adapted for attachment to said submarine pressure hull in an opening in said hull.

2. The torpedo tube hull liner cluster in accordance with claim 1 wherein said first curved seat comprises two of said side wall portions having upper edges formed to conform to said first radius, an upper edge of said end wall portions being formed to conform to said first radius, said two side wall portions having lower edges formed to conform to said second radius, and said end wall portions being formed to conform to said second radius.

3. The torpedo tube hull liner cluster in accordance with claim 2 wherein said rigid beam is an I-beam, and said two side wall portions are first and second flanges of said I-beam.

4. The torpedo tube hull liner cluster in accordance with claim 1 wherein said beam at each end thereof is provided with first and second end wall portions spaced from each other lengthwise of said beam, said first curved seat being formed in part in said first end wall portion, and said second curved seat being formed in part in said second end wall portion.

5. The torpedo tube hull liner cluster in accordance with claim 1, said cluster further comprising:

a second rigid beam having side wall portions and end wall portions, the second beam being provided with a third curved seat formed therein having said second radius and a fourth curved seat formed therein having a third radius; and a third torpedo tube hull liner having a radius substantially equal to said third radius fixed to said second rigid beam in said fourth seat;

said second rigid beam being disposed between said second and third liners and being adapted for attachment to said submarine pressure hull in said opening in said hull.

6. A torpedo tube hull liner cluster for use in a pressure hull of a submarine, said cluster comprising:

a rigid I-beam comprising first and second flanges interconnected by a web portion, and having end blocks fixed to and covering either end of said I-beam, said first and second flanges and said end blocks being provided with a first seat formed therein having a first radius and being further provided with a second seat formed therein having a second radius;

a first torpedo tube hull liner having a radius substantially equal to said first radius fixed to said I-beam in said first seat; and a second torpedo tube hull liner having a radius substantially equal to said second radius fixed to said I-beam in said second seat;

said I-beam being disposed between said first and second torpedo tube hull liners and being adapted for attachment to said submarine pressure hull in an opening in said hull adapted to receive said I-beam and said first and second torpedo tube hull liners.

7. The torpedo tube hull liner cluster in accordance with claim 6 wherein said I-beam at each end thereof is provided with first and second end wall portions spaced from each other lengthwise of said beam, said first curved seat being formed in part in said first end wall portion and said second curved seat being formed in part in said second end wall portion.

8. The torpedo tube hull liner cluster in accordance with claim 6, said cluster further comprising:

a second rigid I-beam comprising third and fourth flanges interconnected by a second web portion, and having second end blocks fixed to and covering either end of said second I-beam, said third and fourth flanges and said second end blocks being provided with a third seat formed therein having said second radius and being further provided with a fourth seat formed therein having a third radius; and a third torpedo tube hull liner having a radius substantially equal to said third radius fixed to said second I-beam in said fourth seat;

said second I-beam being disposed between said second and third torpedo tube hull liners and being adapted for attachment to said submarine pressure hull in said opening in said hull adapted to receive said second I-beam and said third torpedo tube hull liners.

9. A method for making a cluster of torpedo tube hull liners and for attaching said cluster to a submarine pressure hull, said method comprising the steps of:

providing a rigid beam having side walls and end walls;

forming a first seat of a first radius in the rigid beam and a second seat of a second radius in said rigid beam;

fixing a first curved plate, having an outside radius substantially equal to said first radius, to said beam in said first seat and a second curved plate, having an outside radius substantially equal to said second radius, to said beam in said second seat;

providing an opening in said submarine pressure hull adapted to receive said beam and said hull liners;

attaching said beam to said pressure hull in said opening;

fixing additional curved plates of said first radius to said first curved plate to complete a first of said hull liners;

fixing additional curved plates of said second radius to said second curved plate to complete a second of said hull liners; and fixing said hull liners in said opening to said pressure hull.

10. The method in accordance with claim 9 wherein said rigid beam comprises an I-beam, said side walls comprise first and second flange portions of said I-beam, and said end walls comprise end blocks fixed to ends of said I-beam.

11. The method in accordance with claim 10 wherein:

forming said first seat comprises shaping two corresponding edges of said I-beam flanges to form said first radius, and shaping an edge of each of said end blocks to form said first radius; and forming said second seat comprises shaping two other corresponding edges of said I-beam flanges to form said second radius, shaping another edge of each of said end blocks to form said second radius, and said first and second seats being formed on opposite sides of said I-beam.

12. The method in accordance with claim 11 wherein said first curved plate is fixed to said I-beam two corresponding edges and said end block edge, and said second curved plate is fixed to said I-beam two other corresponding edges and said end block other edge.

13. The method in accordance with claim Il wherein ends of said first and second flange portions on one of said sides of said I-beam are spaced from ends of said first and second flange portions on another of said sides of said I-beam, and at either end of said I-beam said end walls comprise first and second portions on said opposite sides of said I-beam, said first end wall portion being spaced from said second end wall portion lengthwise of said I-beam.

* * * * *